US005755644A

United States Patent [19]

Breems

[11] Patent Number: 5,755,644

[45] Date of Patent: May 26, 1998

[54] EXERCISE APPARATUS FOR RUNNING OR WALKING

[76] Inventor: Martinus Van Breems, 9 Violets La., Westport, Conn. 06880

[21] Appl. No.: 745,087

[22] Filed: Nov. 7, 1996

[51] Int. Cl.[6] ..... A47D 13/04; A61H 3/02

[52] U.S. Cl. ..... 482/67; 135/68; 482/74

[58] Field of Search ..... 482/67, 66, 69; 135/68, 66, 71, 73, 74

[56] References Cited

U.S. PATENT DOCUMENTS

| | | |
|---|---|---|
| 788,541 | 5/1905 | Kunkel . |
| 869,128 | 10/1907 | Autenrieth . |
| 1,063,846 | 6/1913 | Winthers . |
| 1,244,928 | 10/1917 | Walters . |
| 1,400,394 | 12/1921 | Warry . |
| 1,635,914 | 7/1927 | Weis . |
| 2,189,429 | 2/1940 | Lundquist . |
| 2,667,917 | 2/1954 | Dustin . |
| 2,818,290 | 12/1957 | Harocopo . |
| 3,289,685 | 12/1966 | Parker . |
| 4,094,330 | 6/1978 | Jong . |
| 4,245,659 | 1/1981 | Shofner . |
| 4,756,524 | 7/1988 | Cooney . |
| 5,348,035 | 9/1994 | Porter ..... 135/68 X |
| 5,458,143 | 10/1995 | Herr ..... 135/68 |

FOREIGN PATENT DOCUMENTS

| | | |
|---|---|---|
| 4102498 A1 | 1/1991 | Germany . |
| 001717135 A | 3/1992 | U.S.S.R. . |

*Primary Examiner*—Richard J. Apley
*Assistant Examiner*—William LaMarca

[57] ABSTRACT

An exercise device including an upper segment secured via an articulating joint to the upper body or arm and a lower segment which is slidably connected to the upper segment. The lower segment includes a hand support or hand grip. The attachment of the upper segment to the body is done via an articulating joint so that the upper segment may be freely moved in an arc of approximately sixty degrees, front to back. The joint provides a selectable amount of friction, thereby enhancing the intensity of the exercise. The upper segment is slidably and rotatably connected to the lower segment allowing the lower segment to be twisted and moved rectilinearly relative to the upper segment. The lower segment is terminated at the bottom in an elastomeric pole tip for absorbing shock. The lower segment pole tip may also incorporate a spring.

17 Claims, 7 Drawing Sheets

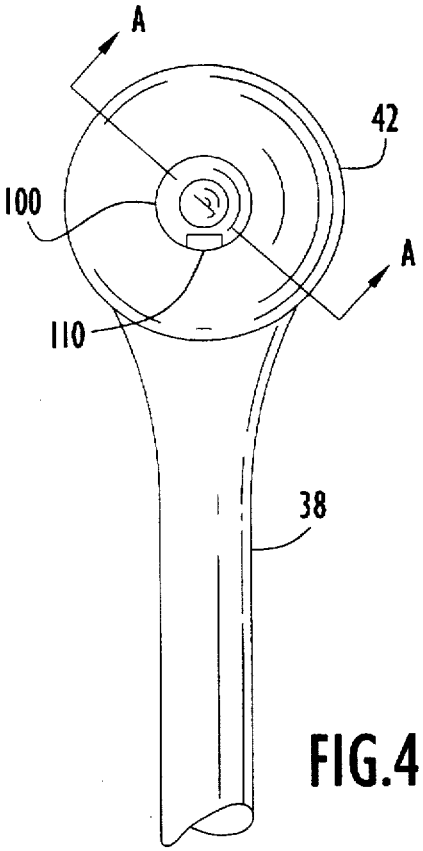
FIG.4
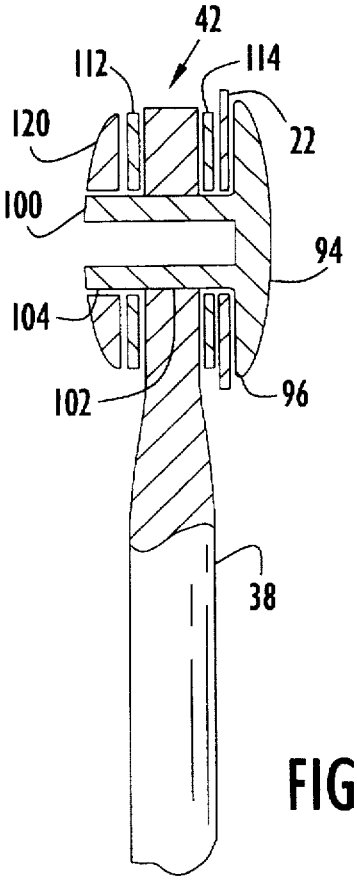
FIG.5
FIG.6A
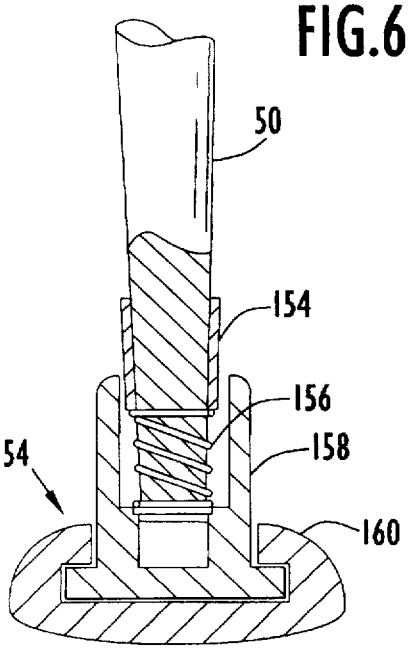
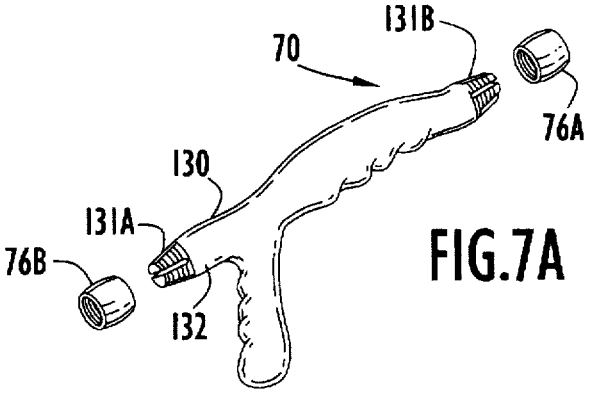
FIG.7A

EXERCISE APPARATUS FOR RUNNING OR WALKING

BACKGROUND OF THE INVENTION

1. Field of the Invention

The present invention relates to an exercise apparatus for use while running or walking. More particularly, the present invention is directed a method for exercising and an apparatus for practicing the method, including exercise poles to be grasped by a user's hands for exerting downward force with the arms and upper body during running or walking.

2. Discussion of the Related Art

Running and walking are popular forms of exercise, but are not suitable for everyone. Many people have difficulty in running because a significant amount of strain is placed on the feet, ankles, knees, hips and back due to jolting forces transmitted through the foot from impact with the ground. People with disabilities also have difficulty in exercising by running or walking and often cannot get a vigorous workout without risking injury from loss of balance. Another difficulty is that running for exercise provides very little work for the upper body.

A number of other forms of exercise have been developed which have proven only partly satisfactory in dealing with such difficulties. Cross-country skiing utilizes poles to provide balance and locomotive force, in turn providing some upper body exercise; however, the poles are primarily useful in a low-friction environment, such as on snow, where only moderate force is used for forward propulsion. Ski poles and similar devices, such as are disclosed in U.S. Pat. No. 4,756,524, are held out in front of the body, making it difficult to provide much downward force in performing an exercise. The body's weight is not borne by the arms, therefore, such devices are not very useful in reducing the strain and jolting forces which the legs and lower body experience while running, and the risk of strained ankles or twisting injuries is not sufficiently reduced.

In the medical arts (as contrasted with the exercise equipment arts), a number of crutches have been disclosed. These are not for use in exercise but for use by patients having difficulty in walking. Crutches, as such, fall into two general categories, underarm crutches and forearm crutches. In general, underarm crutches are intended to support the patient's weight on an upper arm rest at the underarm; a hand grip is used primarily to move the crutch. Forearm crutches include a hand hold for bearing the patient's weight and a forearm brace, to allow the patient to align his or her forearm with the crutch.

Forearm crutches, such as are disclosed in U.S. Pat. No. 5,193,567, present three problems. First, forearm crutches are loosely braced to the forearm to align the forearm with the crutch hand rest, thus concentrating the patient's's weight on the elbow; a running exercise would place unacceptably misaligned loads on the elbow. Second, since the forearm must be braced and linearly aligned with the crutch, arm movement is restricted. Third, the restricted movement imposed by the arm brace makes it awkward to control the position of the crutch, since the crutch must be moved while held by the hand grip.

Neither type of crutch is conducive to a natural and vigorous motion for use in a walking or running exercise. It is not possible to keep the top padded portion of an underarm crutch braced in a user's underarm while extending the hand and arm in a motion which places the user's weight on the hands, thus providing some form of upper body workout.

Analogously, it is not possible to align, move and control the position a forearm crutch in a natural and vigorous walking or running exercise, while placing a significant amount of downward force on the forearm crutch handle. For these reasons, crutches have not been adopted as exercise devices.

Accordingly, there is a need for an exercise device with which a user may obtain vigorous exercise while avoiding the strain and jolting forces typically resulting from running.

OBJECTS AND SUMMARY OF THE INVENTION

A primary object of this invention is to provide exercise poles and a method for exercise providing less risk of injury than running.

Another object of the present invention is to provide a method of exercising the upper body while running or walking.

A further object of the present invention is to provide readily articulable exercise poles with hand holds slidably extendable along the length of the poles and rotatable, thereby permitting a fluid exercise motion.

Another object of the present invention is to provide exercise poles with a harness fastenable to the body to control the alignment and position of the exercise poles.

The present invention provides a method and apparatus for exercise which permits a smooth and well-controlled movement of two exercise poles; in the exercise, a user momentarily bears some weight on the hands, thereby relieving strain on the legs, ankles and feet.

In accordance with the present invention, a new exercise apparatus is disclosed including a harness for attachment to the wearer's upper chest and left and right exercise poles with horizontal hand holds. Each pole has an upper segment secured to the harness via a hinge or articulating joint; a lower pole segment is slidably, coaxially connected to a pole upper segment; the hand hold is affixed to the lower segment.

In an alternative embodiment, the upper segment is connected to the upper arm of the user via an arm band or the like.

Since the pole lower segment is slidably, telescopically held by the pole upper segment, the user may rotate the horizontal hand hold about the common axis of the lower and upper segments and may, by extending the elbow, move the lower segment distally away from the user's body. Hand rotation permits a natural and fluid motion while still allowing the user to place significant downward force on the handholds.

The upper segment is freely moved approximately sixty degrees in a front to back arc about the joint or hinge which can be adjusted to provide a selected amount of friction, thereby providing additional resistance and more strenuous exercise. Preferably, the joint is a mechanical joint with a hub and bushings. Alternatively, a one-piece elastomeric joint, or a coil spring articulating joint can be utilized.

Preferably, the lower segment includes a vertical hand grip on the upper part of the lower segment and the lower segment is detachable from the upper segment. A detached lower segment can be used in a lower intensity workout, in the manner of a ski pole or trekking pole. As noted above, the lower segment also includes a lower horizontal hand hold, for use when the upper and lower segments are slidably connected. The horizontal hand hold may be hollow and include a removable end cap, allowing weights, a light or canisters of a chemical defensive spray (such as mace or pepper spray) to be inserted and retained inside the hand hold. The provision for defensive spray also includes a trigger device and means for directing the spray toward a point of aim. The horizontal hand hold and vertical hand grip may be integrally molded and separated by about ten to twelve inches along a molded grip member, which is normally molded in two halves and is preferably covered with a foam, or the horizontal handhold may be a separate molding fastened over a vertical foam grip.

At the bottom of the lower segment, an elastomeric tip is preferably fitted to absorb shock. A spring may be incorporated, to better absorb shock.

The exercise poles also incorporate a means of attaching the upper segment and hinge to the body which, in the preferred embodiment, is a webbing harness with a horizontal strap running just underneath the armpits, around the back and fastening together over the chest. First and second vertical shoulder straps run from the chest fastener, over the shoulders and down the back to the horizontal strap, where the vertical straps are affixed.

In use, the user dons the harness and grasps the horizontal hand holds on each pole. As the user begins running or walking, a first pole lower segment is swung forward and extended down to plant the first pole and engage the ground. Force is then applied downwardly via the hand, arm and upper body muscles to allow the user to exercise these muscles and lessen the shock and load on the legs. The user then strides past the planted first pole and the lower segment is lifted in a rectilinear contraction along the upper segment axis by contracting the elbow, the pole is then arcuately swung forward, whereupon the cycle is repeated. The second pole is planted while the first pole is being swung forward; the second pole and first pole are planted and moved in an alternating cycle, as are the feet during running or walking. Since the distance between the articulating joint and the hand grip is roughly half the distance between the hand grip and the pole tip, the pole tip can be very quickly moved forward, as is needed when running.

The present invention allows significantly more downward force to be applied than with cross-country ski poles or other exercise poles of the prior art. More force on the hands yields greatly reduced force and shock loads on the legs and lower body while running. Since the weight of the entire body can be momentarily borne by an exercise pole hand hold, the risk of strained ankles and other twisting injuries is greatly reduced. Also, as more downward force can be applied, the user can run or walk more rapidly and thus the exercise can be conducted at a higher rate of intensity.

The foregoing and additional objects, features and advantages of the invention will become apparent to those who are skilled in the art from the following detailed description of a preferred embodiment, taken with the accompanying drawings, wherein like reference numerals in the various drawings identify like components.

BRIEF DESCRIPTION OF THE DRAWINGS

FIG. 4 illustrates a side view of the preferred embodiment of the upper hinge with a friction control nut.

FIG. 5 illustrates a cross-section of the preferred embodiment of the upper hinge.

FIG. 6*a* shows, in cross-section, a first embodiment of the lower pole tip.

FIG. 7*a* is a perspective illustration of a grip member with upper and lower locking nuts.

DESCRIPTION OF THE PREFERRED EMBODIMENT

Figure 1:
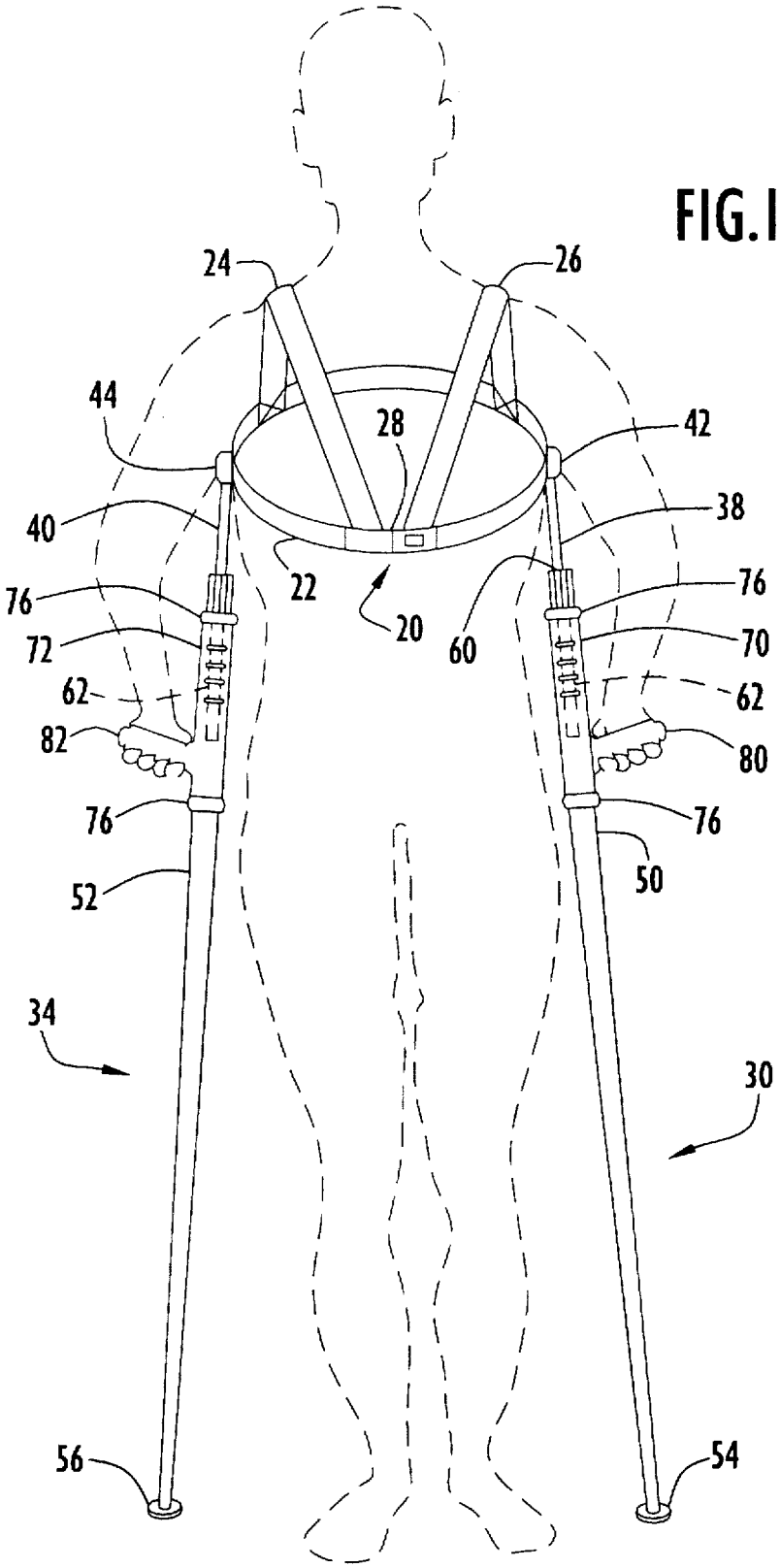
FIG. 1 illustrates, in perspective, a front view of the exercise apparatus of the present invention.

The exercise device according to the present invention is illustrated in FIG. 1. Harness 20 is placed over the shoulders of the user. A horizontal strap 22 is preferably nylon webbing or leather and is connected with first and second vertical straps 24, 26 over the shoulders. The horizontal strap 22 is joined by a buckle, Velcro or similar hook or loop type fastener or resiliently releasable latching clasp 28; the buckle or clasp 28 also includes provisions for attachment and adjustment of the vertical straps 24, 26. Left and right exercise poles 30, 34 each include an elongate upper segment rod 38, 40 having a circular cross-section of a first diameter and being joined to the horizontal strap via a joint 42, 44. Joints 42, 44 allow a selected amount of front to back movement with adjustable friction control. Elongate tubular lower segments 50, 52 slidably receive the upper segments 38, 40. Each lower segment 50, 52 is circular in cross section, has a second inside diameter which is slightly larger than the upper segment first outside diameter and is terminated at a distal end in a pole tip 54, 56. Using the left pole 30 as an example, the distance from the joint 42 to the proximal end 60 of lower segment 50 is preferably in the range of 16 to 20 inches, when the user's feet and the pole tip 54 are on the ground; the upper segment 38 extends approximately ten inches into the lower segment 50 as illustrated by the inserted part of the upper segment 62. Typically, the bottom of upper segment 38, 40 reaches the same level as the user's posterior, when seated.

In one embodiment, grip members 70, 72 are fitted over the lower segments 50, 52 and can be adjusted for vertical position by loosening threaded collet nuts 76 and then retightening them when a satisfactory position is located. The grip members 70, 72 each have a roughly perpendicularly projecting horizontal hand hold 80, 82 to be held when the exercise apparatus of the present invention is used in accordance with the method of the present invention.

Figure 2:
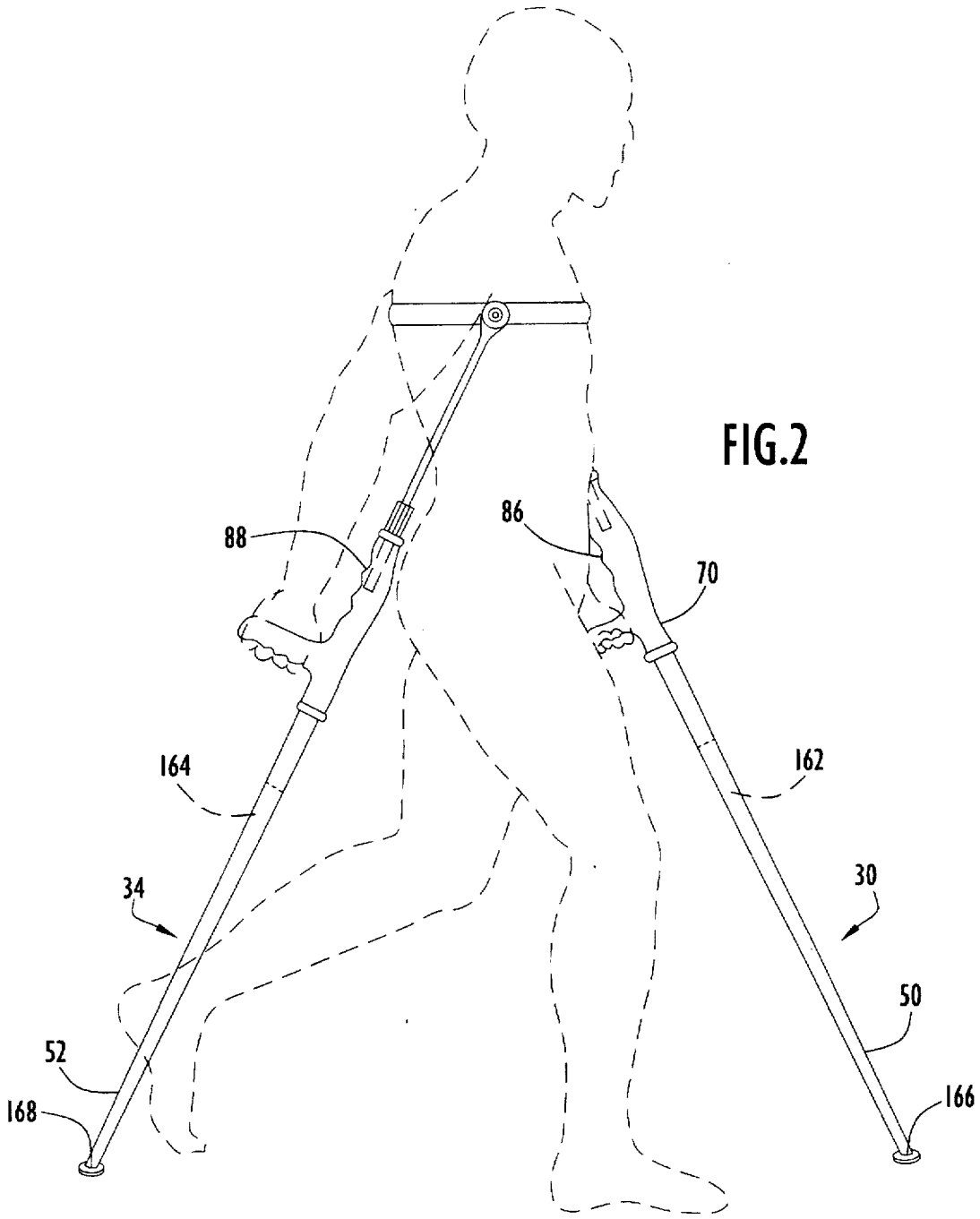
FIG. 2 illustrates, in perspective, a side view of the apparatus of the present invention.

Alternatively, the lower segments 50, 52 can be separated from the upper segments 38, 40 for a less strenuous workout by using the lower segments 50, 52 in a manner similar to the use of cross country ski poles while trekking or skiing. Each grip member 70, 72 includes a vertical grip 86, 88 for this purpose, as shown in FIG. 2.

In the first embodiment, the lower segments 50, 52 are extruded, preferably tapered, aluminum tubing and the upper segment rods 38, 40 are extruded or pultruded plastic or reinforced plastic tubes. Collet nuts 76 are molded from nylon and the grip members 70, 72 are molded in two halves from fiberglass filled nylon. Harness 22 is preferably made from nylon webbing strap. In an alternative embodiment, the harness 22 is a horizontal strap sewn or otherwise attached to a shirt or vest which the wearer simply dons with the harness 22 attached.

The upper segments 38, 40 are slidably, telescopically held within the lower segments 50, 52, and the lower segments may be slidably moved proximally or distally. The lower segments 50, 52 are also rotatable (using the horizontal hand holds 80, 82) about the common, central longitudinal axis of the lower and upper segments. In the illustrated embodiment, the central longitudinal axes of the upper and lower segments (e.g., 38, 50) of the exercise pole 30 are coaxial; however, the only operational requirement is that the upper and lower segments have parallel axes.

Figure 3:
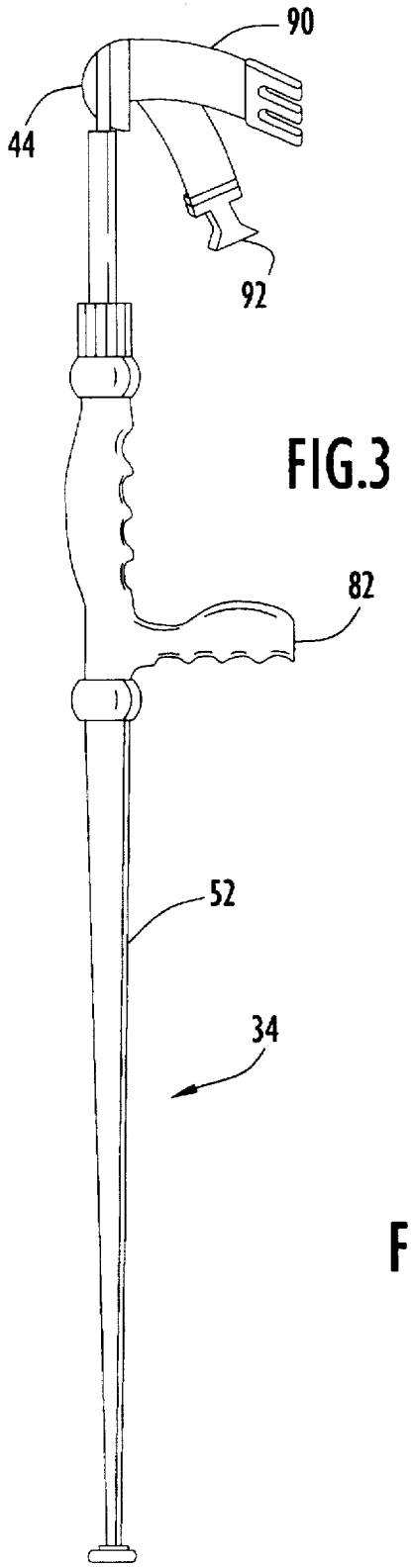
FIG. 3 illustrates a perspective view of an exercise pole with an arm-band harness.

In an alternative embodiment as illustrated in FIG. 3, joint 44 is affixed to an arm-band harness 90 which is detachably attachable with a fastening 92 to a user's upper arm. The arm band is snugly wrapped around the user's upper arm so that, by extending the elbow, the horizontal hand hold 82 is distally displaced from the joint 44 as the lower segment 52 slides along the inserted upper segment 40.

Joints 42, 44 may be hinges, coil springs, or flexible sections made from an elastomeric material. The joints 42, 44 must permit the upper segments 38, 40 to swing in a front to back arc of approximately 60 degrees.

Turning now to FIG. 4, in the preferred embodiment, the joint (e.g., 42) is a hinge and is shown at the proximal end of upper segment 38. FIG. 5 shows a cross-section, taken along line A—A in FIG. 4, of the hinge 42 and upper segment 38. A molded plastic, preferably nylon, shoulder bushing 94 incorporates a wide flange 96 with a rounded profile for contact with the user's body. The other side of flange 96 incorporates raised prongs which engage the webbing strap 22. Flange 96 also incorporates a tubular hub or axle section 100. A rounded annular proximal end of upper segment 38 includes a through bore 102; axle 100 is within upper segment bore 102. A threaded section 104 is fabricated onto the exterior of axle 100, proximate to the axle distal end. The axle has a full length key way integrally molded therein. Washers 112, 114 include a key 110 which engages the axle key way, thereby keeping the washers 112, 114 from rotating. Washers 112, 114 are captively retained on both sides of the upper segment proximal annular end, as illustrated in FIG. 5. A threaded outer nut 120 holds joint 42 together. Washers 112, 114 prevent the rotational force of the upper segment 38 from being transferred to the outer nut 120. Threaded outer nut 120 also allows a selected amount of friction to be generated through tightening of the nut down on the threaded section 104 of axle 100, thus allowing a user to adjust the effort required to move the exercise pole in a fore and aft movement.

FIG. 7*a* shows grip member (e.g., 70) which is typically composed of two molded mirror image halves 130, 132. The mirror imaged halves 130, 132 are held together by upper and lower threaded collet nuts 76*a*, 76*b* which are threadably attachable to upper and lower collet ends 131*a*, 131*b*. The collet ends are slit or notched, preferably in two transverse planes angularly displaced by ninety degrees, thus forming four collet fingers on each collet end. As the collet nut 76 is tightened on the collet end, the collet fingers of the collet end are displaced inwardly to apply frictional force to the lower segment exterior surface, thus fixing the position of the grip member 70 on the lower segment 50. The upper collet nut 76*a* is located at the top of grip member 70 and a lower collet nut 76*b* is located at the bottom of the grip member 70. The lower collet nut 76*b* is required; upper collet nut 76*a* is optional. Collet nuts 76*a*, 76*b* preferably have a knurled external gripping surface and, once loosened, allow the hand grip to be vertically positioned (higher or lower) and radially oriented (rotated about the lower segment longitudinal axis) on the exercise pole. The grip member (e.g., 70) is preferably covered with a thin layer of open cell foam, to cushion the gripping surfaces and improve a user's ability to grasp the grip member with wet hands. The foam is preferably that type of resin or plastic foam customarily used on bicycle or exercise equipment handlebars, such as acrylonitrile, PVC, EPDM or Neoprene foam.

Figures 7B, 7C:
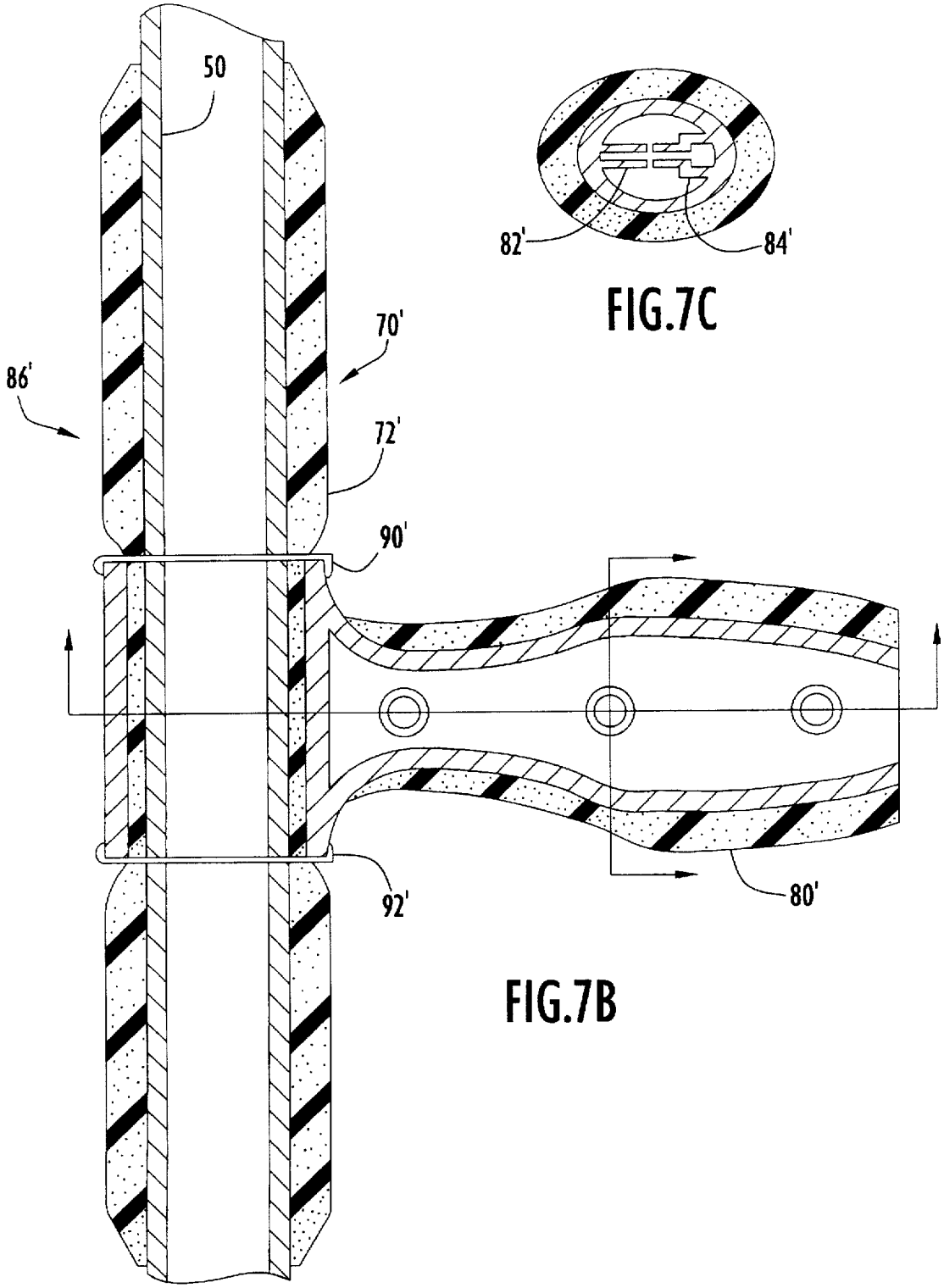
FIG. 7*b* is a cross-sectional illustration of a second embodiment of the grip member.
FIG. 7*c* is a cross-sectional illustration of the horizontal hand hold of the grip member of FIG. 7*b*.
Figure 7D:
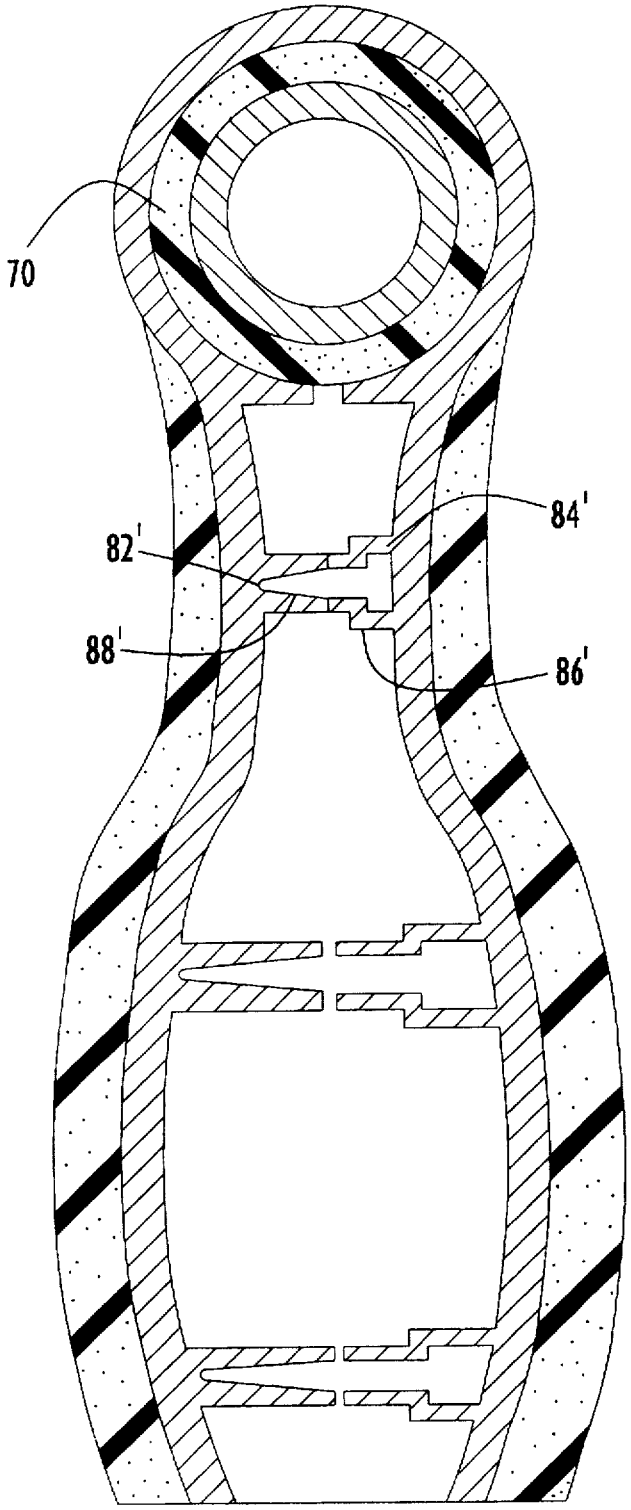
FIG. 7*d* is a cross sectional illustration of the lower segment and horizontal hand hold of the grip member of FIG. 7*b*.

An alternative embodiment of the grip member 70' is illustrated in FIGS. 7*b*, 7*c* and 7*d*. In this embodiment, the grip member 70' is fabricated directly onto the lower segment 50 by first applying a tubular foam rubber hand grip 72' of approximately 12 to 18 inches in length, thereby providing the vertical grip 86' as a comfortable grasping surface for holding the lower segment 50 when it is disconnected from the upper segment 38 and used in ski-pole fashion. The horizontal handhold 80' can be attached by welding a horizontal tube or profile to the vertical tube of lower segment 50, by using a T-type connecting fitting to allow a horizontal tube or profile to be connected to the vertical tube or by any other means which would allow a handle to be connected to the lower segment 50 in a secure manner, to support a working load of approximately 250 pounds. In the embodiment illustrated in FIGS. 7*b*, 7*c* and 7*d*, a one-part plastic molding includes first and second halves 82', 84', secured together around the foam-covered lower segment tube 50. When the two halves 82', 84' are secured together, a middle section of the foam rubber grip 72' is tightly compressed against the lower segment 50 and is secured to the lower segment. The foam rubber grip 72' provides a gasket between the lower segment and the two-part horizontal handhold 80', holding the handhold in position, and isolating the horizontal hand hold somewhat from the lower segment 50, thereby enhancing isolation from vibration and shock. A plurality of vias 86' in the second molded half 84' and blind holes 88' in first molded half 82' accept self tapping screws or the like for securing the two halves 82', 84' of the handhold to one another. First and second press or snap-fit rings 90', 92' affix the first and second molded halves to the foam covered lower segment shaft 50.

Figure 8:
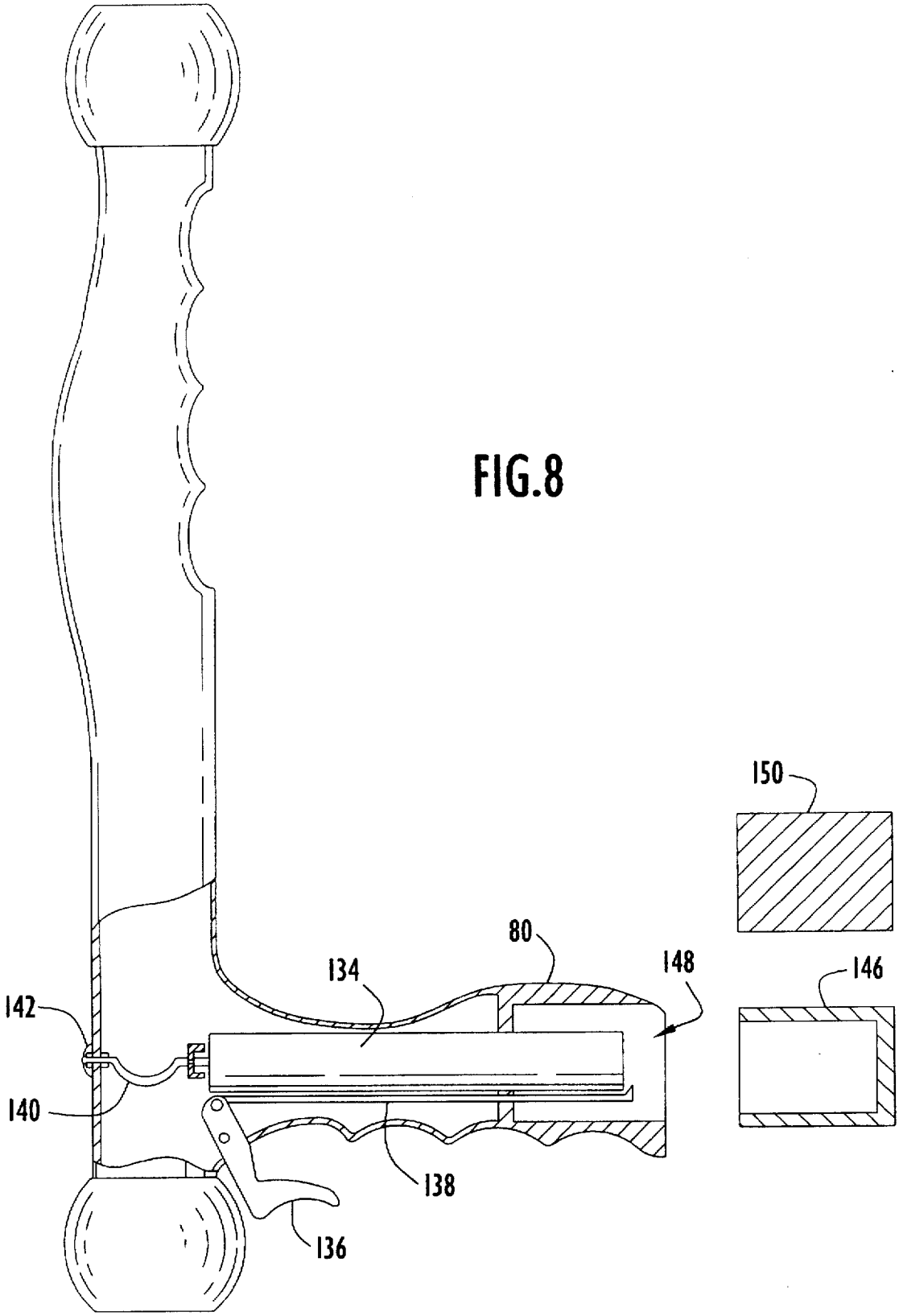
FIG. 8 illustrates a cross-section of the two position hand grip with the storage location for the chemical spray and the trip spray control trigger.

Turning now to FIG. 8, in another alternative embodiment, the end of the horizontal hand hold (e.g., 80) is hollow and is adapted to retain a canister of chemical defensive spray 134. A spray trigger 136 activates the spray through a linkage 138 causing the spray to travel through a tube 140 and a nozzle 142 toward a point of aim. A protective end cap 146 is used to cover the rearwardly facing opening 148 in horizontal hand hold 80. In normal use, the horizontal hand hold 80 will face generally rearwardly and the nozzle 142 will face forward. In an alternative embodiment, a solid weight 150 is substituted for the protective spray and end cap in opening 148. Other accessories can be inserted into the opening 148; a flash light, a signal light, or an audible alarm are examples. Grip members can be configured with interchangeable handhold accessories, so that a user might choose to use a chemical defensive spray handhold on one outing and a flashlight or signal light on another. Such accessories can alternatively be clipped onto the hand hold or lower segment.

In another alternative embodiment, as illustrated in FIG. 2, additional weight can be added to the exercise poles 30, 34 by pouring selected quantities of water 162, 164 into hollow, tubular lower segments 50, 52; the tubular lower segments ends 166, 168 are sealed to retain the water.

Turning now to FIG. 6*a*, one embodiment for a pole tip (e.g., 54) is mounted upon the distal end of lower segment 50 and includes an upper bushing 154 which retains a spring 156. The distal end of spring 156 engages a lower bushing 158 which is movable over upper bushing 154; preferably, a force of approximately fifty pounds is required to completely compress spring 156. Preferably, a medium durometer (about 70–80) elastomer, preferably rubber, cover 160 is molded over lower bushing 158, thereby providing additional impact resistance. Preferably, lower bushing 158 has a great enough diameter (e.g., 0.5–1.0 inch) to prevent the tip from becoming stuck in a sidewalk crack or in soft ground.

Figure 6B:
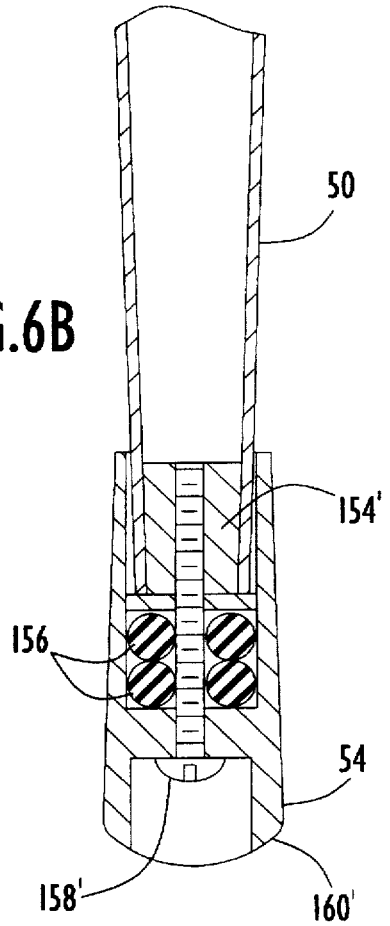
FIG. 6*b* shows, in cross-section, the preferred embodiment of the lower pole tip.

In an alternative embodiment of the pole tip, as illustrated in FIG. 6*b*, a threaded shoulder bushing 154' is slidably inserted into the distal end of lower segment 50. The bushing 154' is sealed and bonded into the end of the lower segment and accepts a threaded fastener 158'. A cover 160' is molded with a through bore for accepting the distal end of the lower segment and the threaded fastener 158 and is preferably molded of a high durometer (approximately 80–100) elastomer, thereby providing additional impact resistance. One or more elastomer O-rings 156 are added to the tip 54' and the amount of elastomer shock absorption can be adjusted by adding or deleting O-rings 156 or using O-rings of selectable durometer, where higher durometer is used for a firmer shock absorber; compressive pre-load can also be adjusted by tightening or loosening threaded fastener 158, thereby adjustably compressing elastomer O-rings 156. Preferably, a force of at least fifty pounds is required to completely compress the elastomer O-rings 156. In an alternative embodiment, a metal belleville or coil spring can be used in the place of the elastomer O-rings 156.

Figure 9:
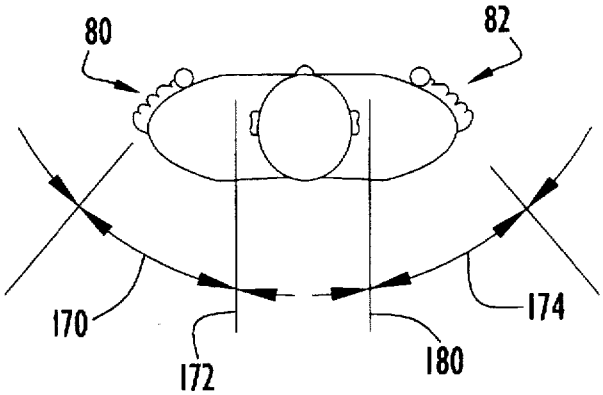
FIG. 9 illustrates a view from above of the user gripping the hand holds.

In practicing the method of the present invention, a user dons the harness 20, slides the upper segments 38, 40 into the lower segments 50, 52, and grasps the horizontal hand holds 80, 82 on each pole 30, 34. Horizontal hand holds 80, 82 may be rotated about the central longitudinal axis of the exercise poles 30,34 to a natural position. As illustrated in FIG. 9, the left hand hold 80 normally points to an eight o'clock position; this corresponds to an outward angle 170 of about 30–60 degrees from an imaginary line 172 pointing to the rear. The right hand hold 82 normally points to a four o'clock position; this corresponds to an outward angle 174 of about 30–60 degrees from a second imaginary line 180 pointing to the rear. The preferred hand orientations for a given user correspond to the angular orientation the hands assume when standing with the arms hanging down at rest. For purposes of nomenclature, these hand orientations are defined as the natural grasping position.

As the user begins running or walking, a pole lower segment (e.g., 50) is swung forward and extended distally down to plant the pole tip 54 and engage the ground. Force is then applied downwardly on the hand hold 80 via the hand, arm and upper body muscles, to allow the user to exercise these muscles and lessen the shock and load on the legs. The user strides past the planted pole 30 and the pole lower segment 50 is lifted in a rectilinear proximal contraction along the upper segment axis by contracting the elbow and the pole is arcuately swung forward, whereupon the cycle is repeated.

When a user's legs are separated by the maximum length of stride, the poles 30, 34 will be as close to each other as possible. As illustrated in FIG. 2, when the right foot is down and in the forward position, the left pole is at the forward most angle and is soon to be planted. The sequence is, then, swinging the left exercise pole 30 forward while extending the left arm and hand, thereby slidably moving the left hand hold 80 distally away from the hinge 42 and slightly twisting or rotating the hand hold; planting the tip 54 of the left exercise pole on the ground at a first point on the ground; placing at least some of the user's weight on the left hand hold 80; then swinging the right exercise pole 34 forward while extending the right arm and hand, thereby slidably moving the right hand hold 82 distally away from the hinge 44 and slightly twisting or rotating the hand hold 82; planting the tip 56 of the right exercise pole on the ground at a second point on the ground; and placing at least some of the user's weight on the right hand hold, and so forth.

In the method of the present invention, the user grasps the hand holds 80, 82 in his or her own natural grasping position and, while swinging the poles forward, may allow the wrists and hands to twist or rotate the hand holds 80, 82, in the natural motion which accompanies swinging of the arms.

Alternative methods of use are also possible with the apparatus of the present invention. It may be desirable to use a single pole as a balancing aid or to reduce risk of injury on only one side. It may also be useful to use two exercise poles as balance aids in especially treacherous terrain.

In alternative embodiments, the exercise poles 30, 34 can be marked with high visibility reflective tape for safety on the road and may be used as supports for flashing lights or the like. A drinking water dispenser may be incorporated into the lower segment water storage area. The harness 20 or arm band harness 90 may be fastened with any releasable fastener equivalent in function to buckle or clasp 28 such as a snap fastener, a button or a hook-and-loop type fastening.

The foregoing describes the preferred embodiments of the present invention along with a number of possible alternatives. A person of ordinary skill in the art will recognize that modifications to the described embodiments may be made without departing from the true spirit and scope of the invention. The invention is, therefore, not restricted to the embodiments disclosed above but is defined in the following claims.

I claim:

1. An exercise apparatus, attached to a user's body and manually grasped by the user, for use while running or walking, comprising, first means for releasable attachment to the user's body;

a first elongate upper segment having a proximal end and a distal end, wherein said first upper segment proximal end is affixed to said first means;

a first elongate lower segment having a proximal end, a distal end and a projecting hand hold on said first lower segment, said lower segment proximal end being slidably and rotatably engaged with said first elongate upper segment distal end;

a second elongate upper segment having a proximal end and a distal end, wherein said second upper segment proximal end is affixed to said first means;

a second elongate lower segment having a proximal end, a distal end and a projecting hand hold on said second lower segment, said lower segment proximal end being slidably and rotatably engaged with said second elongate upper segment distal end;

whereby when a user grasps said projecting hand hold and extends an elbow, the corresponding said lower segment moves distally away from the user's body.

2. The exercise apparatus of claim 1, wherein said first means for releasable attachment to the user's body comprises a chest harness.

3. The exercise apparatus of claim 1, wherein said first means for releasable attachment to the user's body comprises an arm band harness.

4. The exercise apparatus of claim 1, further comprising:

a first pole tip, affixed at said first lower segment distal end; and a second pole tip, affixed at said second lower segment distal end.

5. The exercise apparatus of claim 4, wherein said first pole tip includes an elastomeric pad and a buffer means for absorbing shock.

6. The exercise apparatus of claim 1, wherein said first lower segment projecting hand hold defines a hand-hold interior cavity.

7. The exercise apparatus of claim 6, further including an accessory inserted within said cavity.

8. The exercise apparatus of claim 7, wherein said accessory is a sprayer being operable with an external trigger mounted on said projecting hand hold for actuation of said sprayer.

9. An exercise apparatus, attached to a user's body and manually grasped by the user, for use while running or walking, comprising;

a chest harness with a horizontal strap terminated in a releasable fastener and first and second shoulder straps, for attachment to the user's body;

a first elongate upper segment having a proximal end and a distal end, wherein said first upper segment proximal end includes a hinge affixed to said chest harness horizontal strap;

a first elongate lower segment having a horizontal hand hold, a proximal end and a distal end with a pole tip affixed thereupon, said lower segment proximal end being slidably engaged with said first elongate upper segment distal end;

a second elongate upper segment having a proximal end and a distal end, wherein said second upper segment proximal end includes a hinge affixed to said chest harness horizontal strap;

a second elongate lower segment having a horizontal hand hold, a proximal end and a distal end with a pole tip affixed thereupon, said second lower segment proximal end being slidably engaged with said second elongate upper segment distal end;

whereby when a user grasps said horizontal hand hold and extends an elbow, the corresponding said lower segment moves distally away from the user's body.

10. The exercise apparatus of claim 9, wherein said first elongate lower segment pole tip includes an elastomeric pad and a buffer means for absorbing shock.

11. The exercise apparatus of claim 9, wherein said first lower segment hand hold defines a hand-hold interior cavity.

12. The exercise apparatus of claim 11, further including a weight within said cavity.

13. The exercise apparatus of claim 11, further including a sprayer within said cavity and an external trigger mounted on said hand hold, said trigger actuating said sprayer.

14. The exercise apparatus of claim 9, wherein said first and second upper segments are rods of circular cross-section having a first outside diameter and having a central axis;

wherein said first and second lower segments are tubes of circular cross section having a second inside diameter larger than said first outside diameter;

wherein said first upper segment is slidably inserted coaxially into said first lower segment tube; and wherein said second upper segment is slidably inserted coaxially into said second lower segment tube.

15. The exercise apparatus of claim 14, wherein said first lower segment is sealed at said distal end.

16. The exercise apparatus of claim 15, wherein said first lower segment is at least partially filled with water.

17. The exercise apparatus of claim 14, wherein said first upper segment hinge includes an adjustable friction control.

* * * * *